US006427610B1

(12) United States Patent
Coates et al.

(10) Patent No.: US 6,427,610 B1
(45) Date of Patent: Aug. 6, 2002

(54) HIGH TEMPERATURE INDUSTRIAL FURNACE ROOF STRUCTURE

(75) Inventors: Stephen Coates, Galena; Barry R. James, Apple River, both of IL (US)

(73) Assignee: Merkle Engineers, Inc., Galena, IL (US)

( * ) Notice: Subject to any disclaimer, the term of this patent is extended or adjusted under 35 U.S.C. 154(b) by 0 days.

(21) Appl. No.: 09/685,996

(22) Filed: Oct. 11, 2000

(51) Int. Cl.[7] ..... F23M 5/02; F27D 1/02

(52) U.S. Cl. ..... 110/339; 110/331; 373/73; 266/283

(58) Field of Search ..... 373/71, 72, 73; 428/238, 247, 251, 252; 110/331, 332, 333, 334, 335, 336, 337, 338, 339; 266/283; 52/747.13

(56) References Cited

U.S. PATENT DOCUMENTS

| | | | | | |
|---|---|---|---|---|---|
| 1,711,822 | A | * | 5/1929 | Abbott | 110/339 |
| 2,400,827 | A | * | 5/1946 | Jones | 110/99 |
| 2,612,124 | A | * | 9/1952 | Longenecker | 110/99 |
| 3,056,362 | A | * | 10/1962 | Hosbein et al. | 110/99 |
| 3,802,833 | A | * | 4/1974 | Weber | 432/251 |
| 4,286,529 | A | * | 9/1981 | Musser | 110/340 |
| 4,317,418 | A | * | 3/1982 | Courshon et al. | 110/331 |
| 4,424,756 | A | * | 1/1984 | Merkle | 110/332 |
| 4,453,352 | A | * | 6/1984 | Allen et al. | 52/98 |
| 4,475,470 | A | * | 10/1984 | Merckle | 110/332 |
| 4,840,131 | A | * | 6/1989 | Meumann et al. | 110/336 |
| 4,864,945 | A | * | 9/1989 | Merckle | 110/334 |
| 5,058,268 | A | * | 10/1991 | Smagner | 29/897.31 |
| 5,062,249 | A | * | 11/1991 | Smagner | 52/320 |
| 5,357,540 | A | * | 10/1994 | Merkle et al. | 373/73 |
| 6,058,859 | A | * | 5/2000 | Colosimo | 110/332 |

* cited by examiner

*Primary Examiner*—Ira S. Lazarus
*Assistant Examiner*—K. B. Rinehart
(74) *Attorney, Agent, or Firm*—Pauley Petersen Kinne & Erickson

(57) ABSTRACT

A refractory hanger brick for high temperature industrial furnace roof construction having an elongated upwardly extending refractory portion having a generally rectangular cross section and a lower refractory base portion having a generally rectangular lower face, each side of the base portion having a base length greater than a corresponding side of the elongated upwardly extending refractory portion so as to provide support for insulating material and/or adjacent filler bricks. The upper end of the elongated upwardly extending refractory portion distal from the lower refractory base portion forms a hanger recess along opposite sides of the upper end. At least one generally laterally extending lug is disposed above each of the hanger recesses to retain the hanger in a fixed position and to provide at least one hanger position along the upper end opposite sides.

10 Claims, 6 Drawing Sheets

HIGH TEMPERATURE INDUSTRIAL FURNACE ROOF STRUCTURE

BACKGROUND OF THE INVENTION

1. Field of the Invention

This invention relates to high temperature industrial roof structures, particularly to tin bath roof structures as are used in furnaces for the production of sheet glass. The roof structure of this invention uses hanger bricks which may be hung by metallic hangers from a support structure with a metallic hanger attachable on the hanger brick permitting design to a wide variety of roof widths and oversize hanger bricks and filler bricks to be cut on the job site for adjustment to exact roof widths. The roof structure of this invention may be constructed to a wide variety of dimensions using a single style of hanger brick and a single style of filler brick.

2. Description of Prior Art

High temperature industrial furnaces require interior structures of heatresistant refractory bricks or tiles. Such interior structures are heavy and require support from a substantial support frame which is constructed of structural steel. The roof support frame is usually constructed of large I-beams or wide flange beams with rods suspending metallic hangers from which hanger bricks are suspended. Spaced rows of hanger bricks are suspended from the roof support frame and rows of filler bricks are placed in the space between adjacent rows of hanger bricks and supported on the opposite sides by the adjacent hanger bricks. Hanger bricks typically used for tin bath roofs are shaped so that a hanger may be placed only at the end of the hanger brick. Conventionally, a single metallic hanger supports the ends of two adjacent end-to-end hanger bricks. Present roof structures frequently require as many as 8 to 12 different styles of hanger bricks and as many as 8 to 12 different styles of filler bricks, necessitating that many different molds with manufacture of that many styles of brick together and supply of that many styles of brick to the job site, to accommodate varying roof dimensions.

One concept which addresses these issues is taught by U.S. Pat. No. 5,357,540. There a hanger brick is disclosed having a flat generally rectangular lower face which is at least about 2 ½ times as long as it is wide, which lower face portion of the brick has a filler brick support ledge extending outwardly for the full length of the brick along opposite sides for sufficient height and outward distance to support adjacent filler bricks. A narrower upper hanger portion of the brick has a hanger recess for the full length of the brick along opposite sides to provide bearing for a hanger suspending the hanger brick. The upper hanger portion of the brick, above the hanger recess, has a plurality of spaced generally laterally extending lugs providing a plurality of hanger attachment positions along the hanger portion of this hanger brick. One end of the hanger brick has an extending ridge and the opposite end has a recess sized to accept the corresponding extending ridge on the edge of an adjacent hanger brick.

Current practice, acceptable for conventional bath roof design, is to have the lower end of the suspension metallic close to the refractory hot-face. However, such a design in a high temperature tin bath application results in exposure of the suspension metallic to extremely high temperatures—sufficient to cause failure. In addition, current designs limit the amount of insulation which can be used as a result of which a substantial amount of heat loss can occur.

SUMMARY OF THE INVENTION

Accordingly, it is one object of this invention to provide a refractory hanger which is designed so as to allow optimum insulation of the roof in high-temperature manufacturing processes while simultaneously protecting the suspension metallics.

This and other objects of this invention are addressed by the use of a refractory hanger brick comprising an elongated upwardly extending refractory portion (also referred to herein as a "post") having a generally rectangular cross section in a direction transverse to its length and a lower refractory based portion having a generally rectangular lower face. Each side of the base portion has a base length greater than a corresponding side of the elongated upwardly extending refractory portion so as to provide support for insulating material and/or adjacent filler bricks. The upper end of the elongated upwardly extending refractory portion distal from the lower refractory base portion forms a hanger recess on opposite sides thereof. At least one generally laterally extending lug is disposed above each hanger recess to retain the hanger in a fixed position and to provide at least one hanger position along the opposite sides of the upper end of the elongated upwardly extending refractory portion of the refractory hanger brick.

In accordance with one embodiment, one substantially vertical face of the lower refractory base portion comprises a ridge disposed generally parallel to the lower face and an opposite substantially vertical face of the lower refractory base portion forms a recess sized to mate with the ridge of an adjacent hanger brick. In accordance with another embodiment of this invention, a refractory knob or key extending outwardly from opposite sides of the elongated upwardly extending refractory portion proximate the lower refractory base portion is provided for mating with corresponding recesses in the sides of refractory "rail" bricks interposed between adjacent refractory hanger bricks.

Filler bricks used in high temperature furnace roof structures of this invention have a flat generally rectangular lower face which is generally wider in width than a refractory hanger brick. The length of the filler brick is not critical, but is typically less than the length of the hanger brick so that the end joints do not match. The filler bricks have generally flat end faces and the lower portion on opposite sides has a recess to match the outwardly extending filler brick support ledge, by which a row of filler bricks is supported on opposite sides between rows of hanger bricks. This design of filler brick allows each filler brick to be removed by lifting upwardly. The roof design of this invention considerably reduces joint lengths in the furnace roof, since presently used filler bricks are about the same width as the hanger bricks, and increases accessability to the cold side of the bricks for repair and placement, since considerably fewer hanger bricks are required for a given area.

Similarly, refractory "rail" bricks used in high temperature furnace roof structures of this invention have a flat generally rectangular lower face which in width is wider than the width of a refractory hanger brick. The length of the refractory rail brick is not critical, but is generally less than the length of the corresponding side of the refractory hanger brick on which the refractory rail brick is disposed. Like the filler bricks, the refractory rail bricks have generally flat end faces and the lower face portion on opposite sides has a recess to match the outwardly extending support ledge of the refractory hanger bricks by which a row of refractory rail bricks are supported on opposite sides between rows of refractory hanger bricks. A portion of the opposite sides above the recesses formed by the refractory rail brick forms a key recess which mates with the refractory knob or key on the refractory hanger brick so as to provide a guide for locating the refractory rail bricks between adjacent rows of the refractory hanger bricks. As in the case of the filler bricks, this design of refractory rail bricks allows each rail brick to be removed by lifting upwardly.

Sub-assemblies, or bays, along the length of the furnace may be made a variety of lengths using the refractory hanger brick, refractory filler brick and refractory rail brick of this invention. The width of the bricks may be made in metric dimensions to accommodate metric dimensions for the furnace length. Likewise, the roof structure of this invention may be readily designed to various roof dimensions by use of shorter end bricks which may continue to be supported by hangers in the same fashion as the rest of the roof.

Electrically heated tin bath furnace roofs of this invention have electrical bus bars which extend lengthwise of the roof and are fed through the top of the furnace casing requiring less length wire leads and avoiding obstructions at the side of the furnace, as compared to present tin bath roofs in which electrical bus bars generally extend across the width of the roof and are fed through the side or top of the furnace casing.

BRIEF DESCRIPTION OF THE DRAWINGS

These and other objects of this invention will be better understood from the following detailed description taken in conjunction with the drawing wherein.

DESCRIPTION OF PREFERRED EMBODIMENTS

Figure 1:
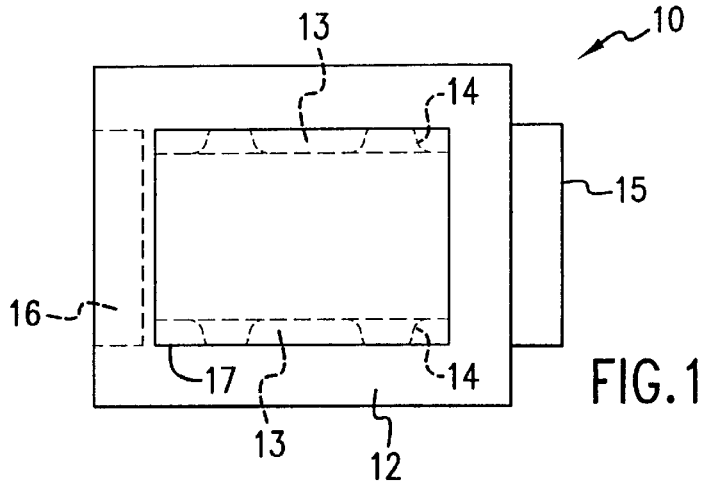
FIG. 1 is a top view of a hanger brick in accordance with one embodiment of this invention.
Figure 2:
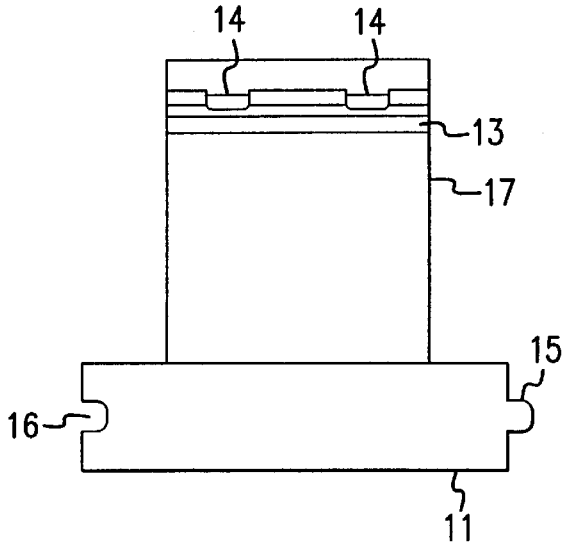
FIG. 2 is a side view of the hanger brick shown in FIG. 1.
Figure 3:
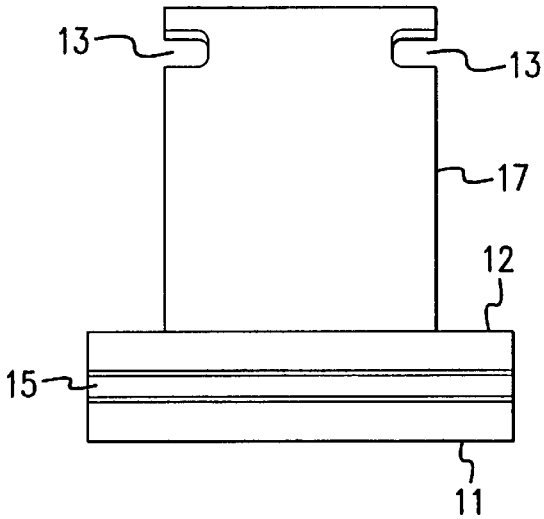
FIG. 3 is an end view of the hanger brick shown in FIG. 1.

A hanger brick of this invention shown as 10 in FIGS. 1–3, comprises an elongated upwardly extending refractory portion 17 having a generally rectangular cross section in a direction transverse to its length and a lower refractory base portion 12 having a generally rectangular lower face, each side of which has a base length greater than a corresponding side of elongated upwardly extending refractory portion 17 so as to provide support for insulating material and/or adjacent filler bricks. The upper end of elongated upwardly extending refractory portion 17 distal from lower refractory base portion 12 forms a hanger recess 13 along upper end opposite sides proximate the upper end. At least one general laterally extending lug 14 is disposed above each of the hanger recesses so as to retain the hanger in a fixed position. In accordance with one embodiment of this invention, one substantially vertical face of lower refractory base portion 12 comprises a ridge 15 disposed generally parallel to lower face 11 and an opposite substantially vertical face of lower refractory base portion 12 forms a recess 16 sized to mate with the ridge 15 of an adjacent hanger brick 10. In accordance with one embodiment of this invention, elongated upwardly extending refractory portion 17 extends at least 13 inches above lower base portion 12.

Figure 2B:
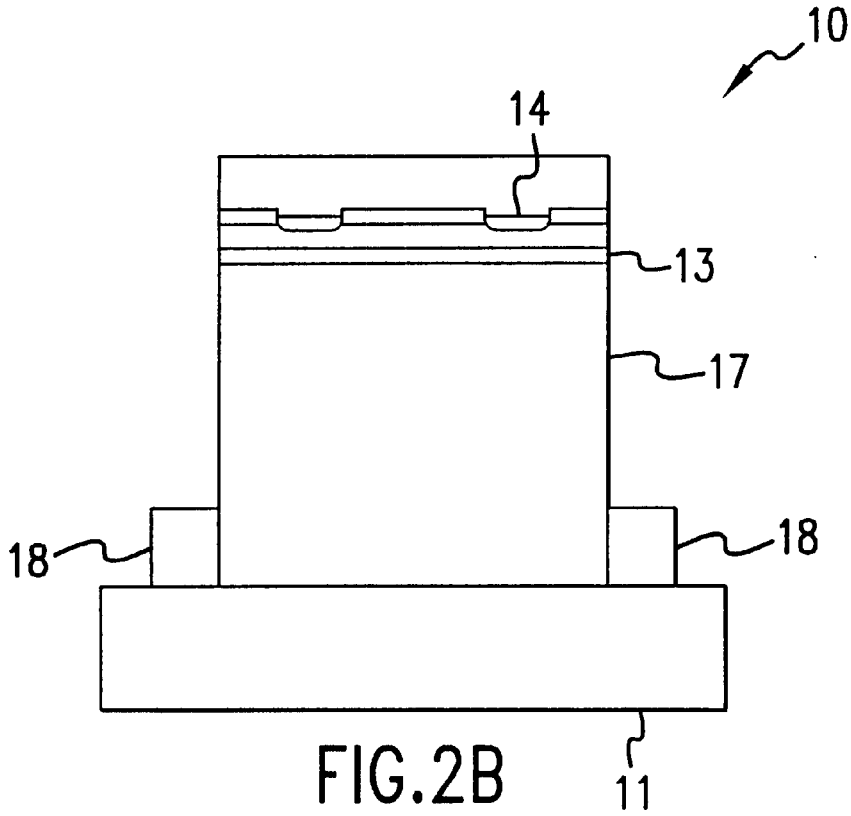

In accordance with one embodiment of this invention as shown in FIG. 2B, refractory hanger brick 10 comprises a key portion 18 extending outwardly from opposite sides of elongated upwardly extending refractory portion 17 proximate lower refractory base portion 12. The purpose of key portion 18 is to ensure proper alignment of the hanger rails discussed hereinbelow.

Figure 4:
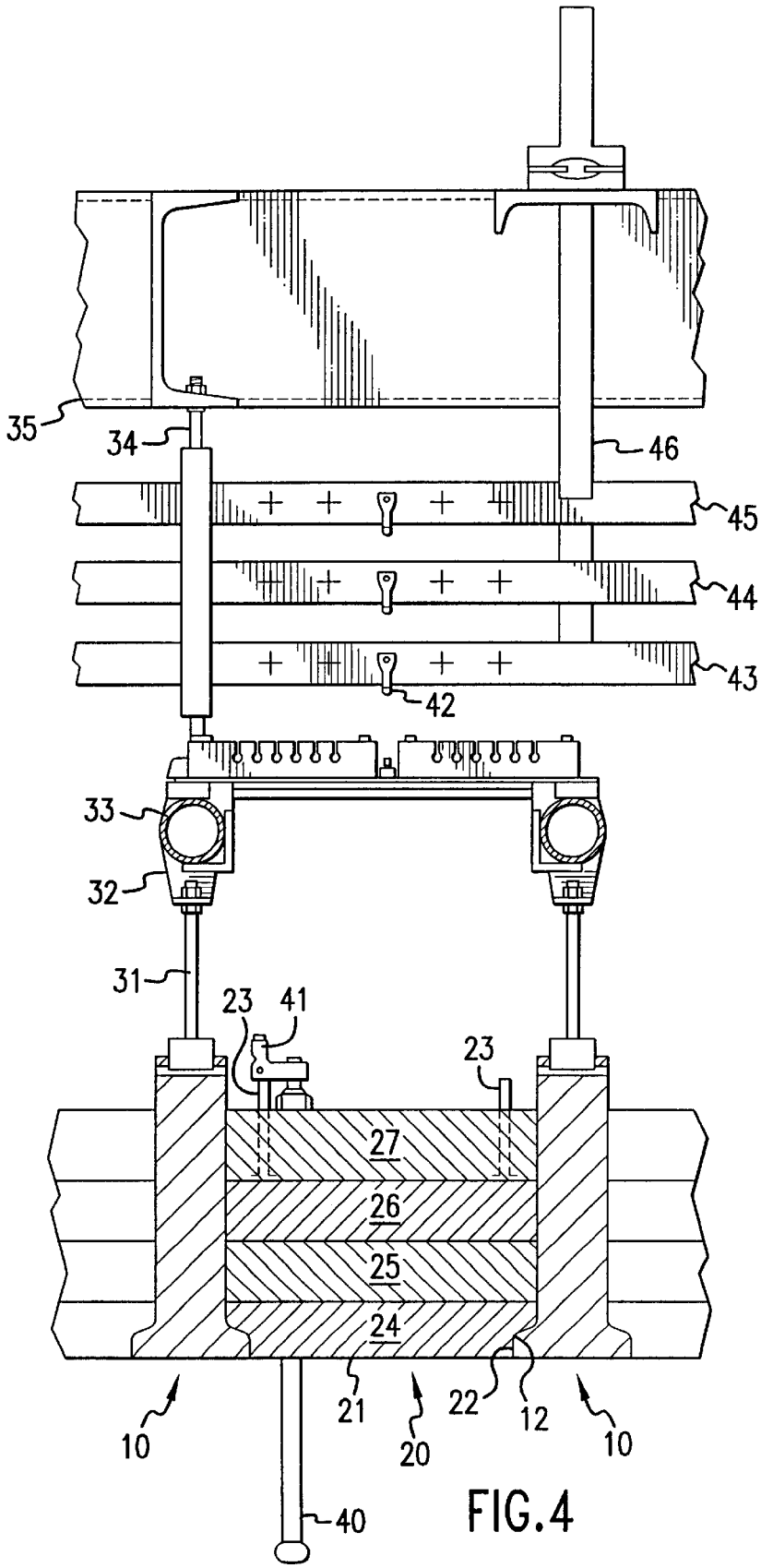
FIG. 4 is a cross sectional view of the length of a furnace through a filler brick module showing longitudinal bus bars and casing top electrical entry.

A cross section along the length of a furnace through a filler brick module is shown in FIG. 4 with hanger bricks 10 supporting filler brick 20. Hanger brick 10 is suspended by metallic hanger casting 30 which is suspended by hanger rod 31 and hanger pipe clamp 32 from hanger pipe 33. Hanger pipe 33 is suspended by suspension rod 34 from roof support frame 35. The double suspension system used in the roofs of this invention provides flexibility in hanger brick suspension and decreases obstacles in the space between the upper side of the furnace roof and the furnace casing.

Filler brick 20 has flat generally rectangular lower face 21 and is shown in FIG. 4. The filler bricks are as wide as is consistent with required strength which, again, reduces the number of metallic hangers required to suspend the roof structure. Filler brick 20 has generally flat end faces and side faces with the lower face portion on opposite sides having recess 22 to mate with lower refractory base portion 12. This design obviates the need for mortar in the joints between the filler brick and hanger and allows for expansion of the structural elements as necessary. This configuration of filler brick 20 allows each filler brick to be removed by lifting upwardly using lifting hooks 23. Filler bricks may be fabricated from refractory materials having lesser heat resistance from hot or interface of the filler brick to the cold or outer face of the filler brick, as shown by numerals 24, 25, 26 and 27 in FIG. 4. Refractory layer 24 has sufficient heat resistance to withstand the temperatures of the furnace, while layers 25 through 27 may have somewhat less heat resistance. Suitable refractory materials are well known to those skilled in the art. These refractory layers may be assembled using either adhesives or a mechanical fastener. Insulation materials may be placed on top of both hanger bricks and the filler bricks to provide a flat top surface which may be easily cleaned. The filler bricks may have holes to accommodate heating elements 40, as desired to meet the heating requirements of the furnace.

Figure 5:
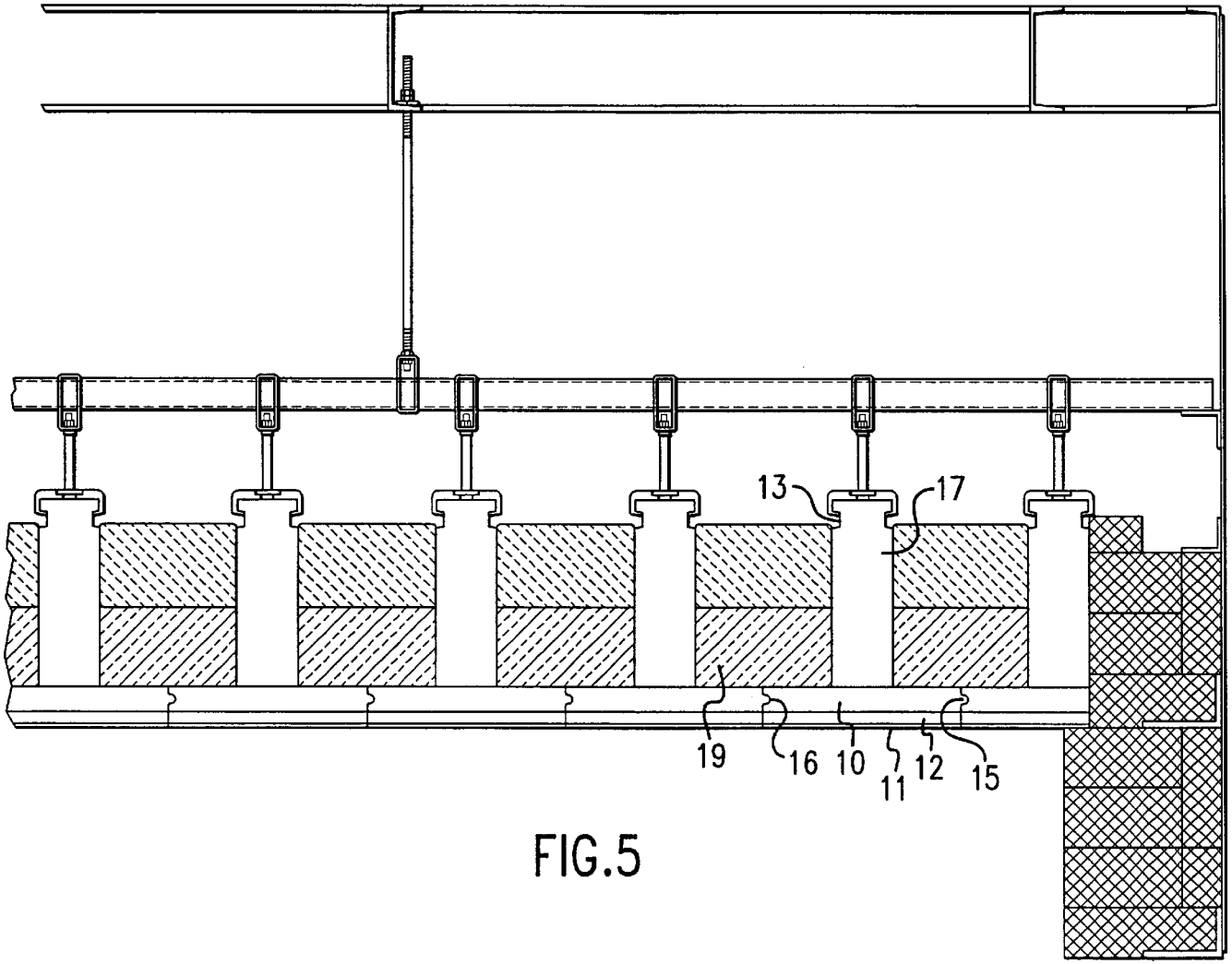
FIG. 5 is a cross sectional view along a portion of the width of a furnace through hanger bricks in accordance with one embodiment of this invention.

FIG. 5 shows a half cross section through hanger rows of a furnace roof structure in accordance with one embodiment of this invention. Disposed between upwardly extending portion 17 (hanger post) is insulation 19.

Figure 6:
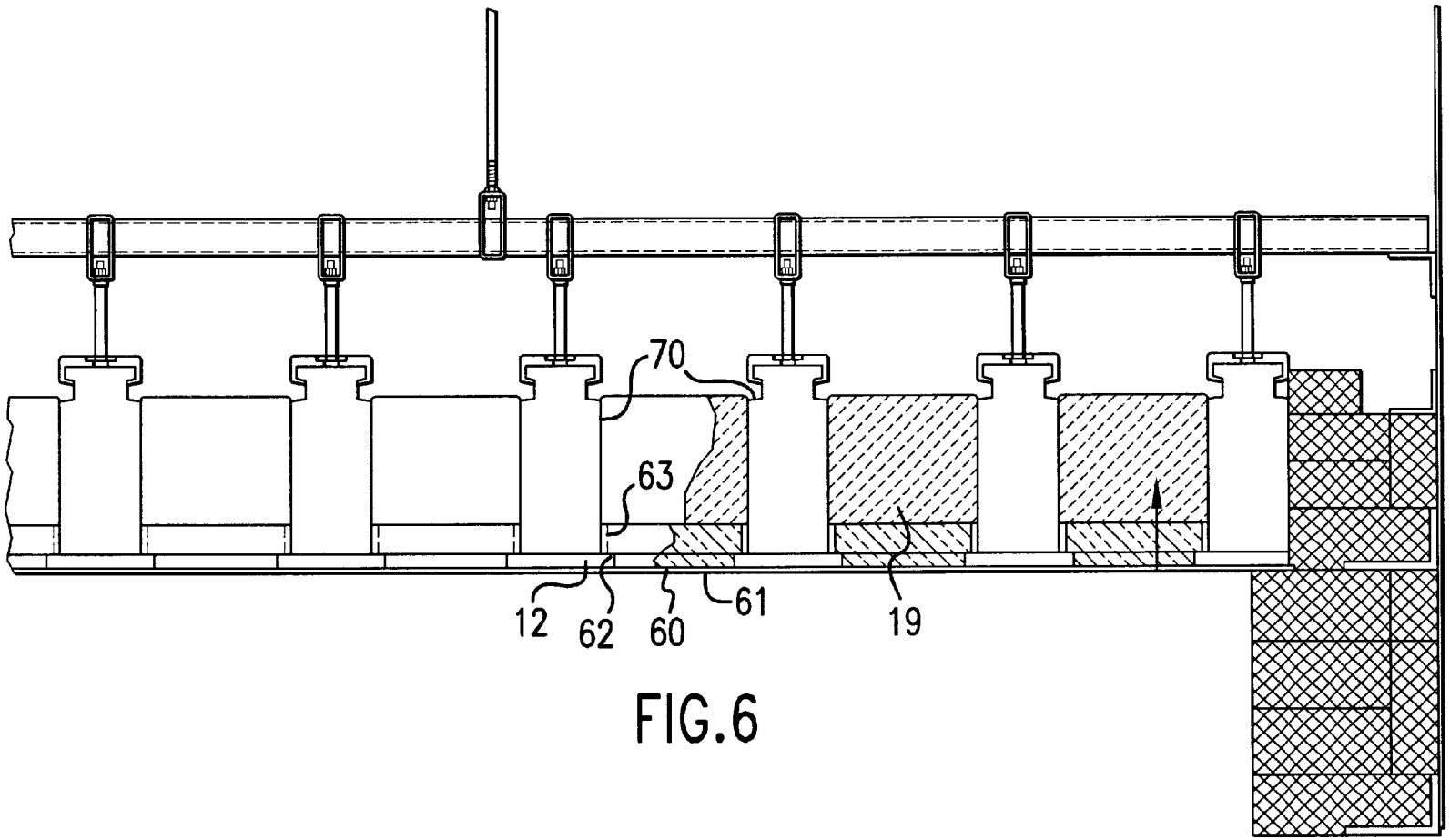
FIG. 6 is a cross sectional view along a portion of the width of a furnace showing the hanger and rail bricks in accordance with another embodiment of this invention.

FIG. 6 is a partial cross sectional view corresponding to the view of FIG. 5 of the high temperature industrial furnace roof structure in accordance with one embodiment of this invention. In accordance with this embodiment, the lower refractory base portion 12 is without the extending ridges 15 and corresponding recesses 16 as shown in FIG. 5. Rather, disposed between hanger brick 10 is a hanger rail 60 which has a generally rectangular hanger rail lower face 61 which is substantially flat. Hanger rail 60 has generally flat end faces and side faces with the lower face portion on opposite sides having recess 62 to mate with lower refractory base portion 12 of refractory hanger brick 10. To facilitate alignment of hanger rails 60, each refractory hanger brick comprises keys 63 which fit into a corresponding slot formed by hanger rail 60. In accordance with the embodiment shown in FIG. 6, hanger insulation 19 is disposed on top of hanger rail 60.

Figure 7:
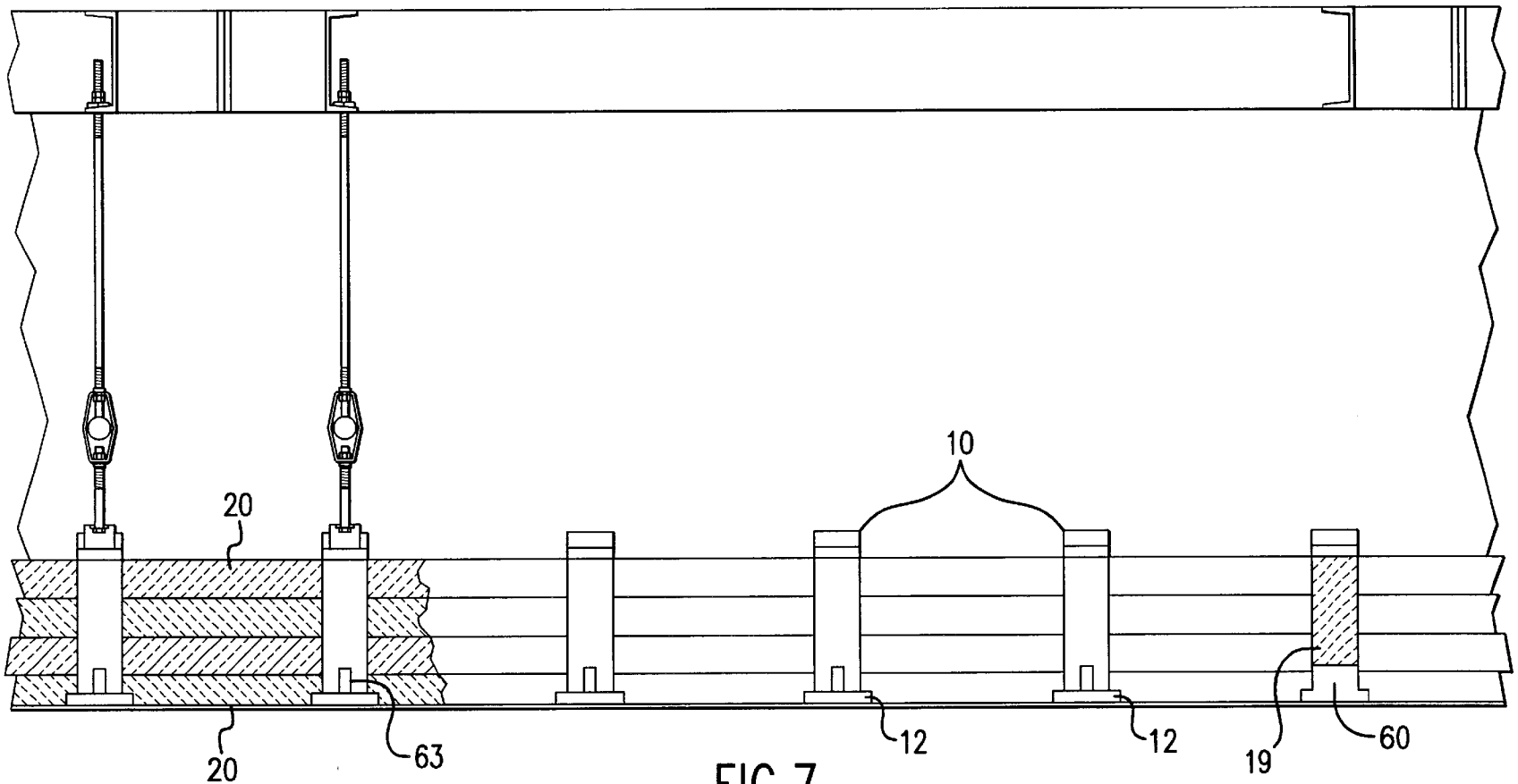
FIG. 7 is a cross sectional view along the length of a furnace through the hanger bricks in accordance with FIG. 6.

FIG. 7 is a partial cross sectional longitudinal view of the furnace roof structure shown in FIG. 6 in which keys 63 are clearly shown. And, as shown, disposed between hanger bricks 10 is filler brick 20. is can also be seen, the length of a side of the lower face 61 of the refractory hanger rail 60 substantially corresponds to the length of the lower base portion 12 of hanger brick 10 on the side of which key 63 is disposed.

As shown in FIG. 4, electrical heating element 40 may be placed through filler brick 20 having a hole therefore, with cable connection 41 exterior to the top of filler brick 20 for attachment to a cable leading to a cable connecter 42 on one of longitudinal bus bars 43, 44 and 45. Longitudinal bus bars 43, 44 and 45 are supplied by electrical supply strap 46 which exits through the top of the furnace casing for connection with an electrical supply source, not shown. Supply of electrical energy through the top of the furnace casing avoids wiring at the sides of the furnace, thereby eliminating electrical connections close to a plant traffic area. The longitudinal bus bars significantly reduce the number of obstructions above the refractory roof, affording better access to areas above the roof requiring maintenance.

As previously stated, the length of the post portion of refractory hanger brick 10 is at least about 13 inches. This hanger post design allows for combinations of up to about 13 inches of insulation. In accordance with one preferred embodiment, the insulation material comprises one 3-inch layer each of 2600° F. and 2300° F. insulating firebrick and two 3 ¼-inch layers of 2000° F. insulating firebrick capped with one ½-inch layer of structural (high density) insulation. Another preferred combination of material in accordance with this invention comprises one 3 ¼-inch layer of 2600° F. insulating firebrick and three 3 ¼-inch layers of 2300° F. insulating firebrick.

One of the benefits of the high temperature industrial furnace roof structure of this invention is a reduction in the heat loss. Calculated heat loss from a high temperature industrial furnace employing the roof structure of this invention shows a reduction of about 25% in heat loss when compared to conventional high temperature industrial furnace roof structures. Actual heat loss will be affected by many factors, including but not limited to, bath temperature, ambient temperature, atmosphere type and quantity, glass type, glass thickness, product throughput, and heating element usage.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A refractory hanger brick for high temperature industrial furnace roof construction comprising;

an elongated upwardly extending refractory portion having a generally rectangular cross section in a direction transverse to its length, a lower refractory base portion having a generally rectangular lower face having four sides, each said side having a length greater than a corresponding side of said elongated upwardly extending refractory portion, thereby forming a support ledge for supporting at least one of insulating material and adjacent filler bricks, and an end portion of said elongated upwardly extending refractory portion which is distal from said lower refractory base portion forming a first hanger recess and a second hanger recess each extending along one of opposite said corresponding sides of said elongated upwardly extending refractory portion; and said elongated upwardly extending refractory portion having at least one generally laterally extending lug above each of said first hanger recess and said second hanger recess, and the at least one generally extending lug extending outward one of said opposite corresponding sides wherein a first face of a first side of said lower refractory base portion comprises a ridge extending along said first side generally parallel to said lower face, a second face of a second side of said sides of said lower refractory base portion forms a recess extending along said second side, which is opposite said first side, and said recess is sized to mate with said ridge on an adjacent hanger brick.

2. A refractory hanger brick in accordance with claim 1, wherein said elongated upwardly extending refractory portion extends at least 13 inches above said lower base portion.

3. A refractory hanger brick in accordance with claim 1 further comprising a key portion extending outwardly from opposite said corresponding sides of said elongated upwardly extending refractory portion proximate said lower refractory base portion.

4. In a high temperature industrial furnace roof having its length substantially greater than its width and comprising along said length of said roof alternate hanger brick rows extending across said width of said roof, each said hanger row comprising a plurality of hanger bricks suspended from a roof support structure and filler brick rows each extending between said hanger bricks across said width of said roof, each said filler brick row comprising an end to end plurality of filler bricks supported by adjacent hanger bricks, the improvement comprising.

a single configuration hanger brick comprising an elongated upwardly extending refractory portion having a generally rectangular cross section in a direction transverse to its length, a lower refractory base portion having a generally rectangular lower face having four sides, each said side of said base portion having a length greater than a corresponding side of said elongated upwardly extending refractory portion, thereby forming a support ledge for supporting at least one of insulating material and adjacent filler bricks, and an end portion of said elongated upwardly extending refractory portion which is distal from said lower refractory base portion forming a first hanger recess and a second hanger recess each extending along one of opposite said corresponding sides of said elongated upwardly extending refractory portion; and said elongated upwardly extending refractory portion having at least one generally laterally extending lug above each of said first hanger recess and said second hanger recess, and the at least one generally extending lug extending outward to one of said opposite corresponding sides wherein a first face of a first side of said lower refractory base portion comprises a ridge extending along said first side generally parallel to said lower face, a second face of a second side of said sides of said lower refractory base portion forms a recess extending along said second side, which is opposite said first side, and said recess is sized to mate with said ridge on an adjacent hanger brick.

5. In a high temperature industrial furnace roof in accordance with claim 4, wherein said elongated upwardly extending refractory portion extends at least 13 inches above said lower base portion.

6. In a high temperature industrial furnace roof in accordance with claim 4, further comprising a single configuration filler brick having a flat generally rectangular lower face having a filler brick width greater than a hanger brick width of said lower refractory base portion, generally flat end faces, and generally flat side faces.

7. In a high temperature industrial furnace roof in accordance with claim 4, further comprising insulation material disposed on said refractory base portions of said adjacent hanger bricks.

8. In a high temperature industrial furnace roof in accordance with claim 8, further comprising a key portion extending outwardly from opposite said corresponding sides of said elongated upwardly extending refractory portion proximate said lower refractory base portion.

9. In a high temperature industrial furnace roof in accordance with claim 4, wherein each of said refractory hanger bricks is suspended by a metallic hanger casting fitting mounted in at least one of said first hanger recess and said second hanger recess, and said metallic hanger casting is suspended by a hanger rod and hanger pipe clamp from a hanger pipe which is suspended by a suspension rod from a roof support furnace.

10. In a high temperature industrial furnace roof in accordance with claim 4, wherein a plurality of said filler bricks form an opening containing an electrical heating element having a wire lead attached to its end extending above said filler brick, an opposite end of said wire lead being attached to one of a plurality of electrical bus bars oriented parallel to said length of said furnace, and said electrical bus bars being fed through a top casing of said furnace.

* * * * *